US012721433B2

(12) United States Patent
Douglas

(10) Patent No.: US 12,721,433 B2
(45) Date of Patent: Sep. 1, 2026

(54) WATER-RESISTANT STORAGE ASSEMBLY

(71) Applicant: Teak Isle Manufacturing, Inc., Ocoee, FL (US)

(72) Inventor: Bryan Douglas, Orlando, FL (US)

(73) Assignee: Teak Isle Manufacturing, Inc., Ocoee, FL (US)

( * ) Notice: Subject to any disclaimer, the term of this patent is extended or adjusted under 35 U.S.C. 154(b) by 1015 days.

(21) Appl. No.: 17/950,793

(22) Filed: Sep. 22, 2022

(65) Prior Publication Data

US 2024/0101224 A1 Mar. 28, 2024

(51) Int. Cl.

| | |
|---|---|
| ***A47B 88/00*** | (2017.01) |
| ***A47B 88/40*** | (2017.01) |
| ***A47B 88/90*** | (2017.01) |
| ***A47B 88/944*** | (2017.01) |
| *B63B 17/00* | (2006.01) |
| *F25D 25/02* | (2006.01) |

(52) U.S. Cl.

CPC ..... *A47B 88/90* (2017.01); *A47B 88/40* (2017.01); *A47B 88/941* (2017.01); *A47B 88/944* (2017.01); *B63B 17/00* (2013.01); *F25D 25/025* (2013.01)

(58) Field of Classification Search

CPC ..... A47B 88/90; A47B 88/941; A47B 88/944; A47B 88/95; A47B 88/956; F25D 25/025; B63B 17/00

See application file for complete search history.

(56) References Cited

U.S. PATENT DOCUMENTS

| | | | | | |
|---|---|---|---|---|---|
| 3,542,447 | A * | 11/1970 | Himelreich | A47B 88/906 | 220/4.01 |
| 5,255,965 | A * | 10/1993 | Chen | E05D 11/105 | 16/334 |
| 2013/0200765 | A1* | 8/2013 | Foss | B60P 3/36 | 312/240 |

FOREIGN PATENT DOCUMENTS

| | | | | |
|---|---|---|---|---|
| CN | 112577258 A | * | 3/2021 | F25D 25/025 |
| KR | 101346719 B1 | * | 1/2014 | B63B 29/04 |
| KR | 20140045862 A | * | 4/2014 | A23B 7/10 |

* cited by examiner

*Primary Examiner* — Kimberley S Wright

(74) *Attorney, Agent, or Firm* — Taft, Stettinius & Hollister LLP

(57) ABSTRACT

A water resistant storage assembly for a boat or other vehicle including a drawer assembly or a hinged-door assembly coupled to a cabinet, wall, or other compartment. The storage assembly may include a series of faces featuring or defining self-draining channels adapted to redirect inbound water or other fluids away from the interior storage area and towards an external wall or other external surface.

20 Claims, 5 Drawing Sheets

WATER-RESISTANT STORAGE ASSEMBLY

TECHNICAL FIELD OF THE INVENTION

The present invention relates generally to a storage assembly, more particularly to a water-resistant drawer or door assembly that controls water intrusion for a boat or other vehicle.

BACKGROUND OF THE INVENTION

Storage and more particularly, organized storage, on boats and other water-going vessels is subject to the unique conditions in which the boat operates. The ever-present wet conditions in and around boats make dry storage and organization of non-water resistant materials or any other cargo problematic. In addition to the watery environments in which they operate, a properly maintained boat also requires the added maintenance of rinsing or spraying down any surfaces, including decks, platforms, walls, and storage compartments, especially when used in salt-water environments.

Storage solutions on boats, including drawers or cabinets, often suffer from water intrusion between cracks or spaces separating the drawer face from the surrounding cabinetry or walls. While these traditional drawers may suffice to keep the contents of the drawer dry from intermittent water or spray, they cannot prevent consistent and/or high pressure water, like that from a hose, over-spray, or other continuous water application from entering the internal storage area of the drawer.

While water-tight storage solutions exist, such devices with intricate seals, gaskets, fastening mechanisms, and significant effort and cost are require to ensure a sealed and secure closure. Such devices can be cumbersome, tedious, and time-consuming to open and close. Such devices also require their own maintenance and service to ensure resilient and effective operations. The cumbersome nature of traditional water-resistant containers prevents quick and efficient access, retrieval, and storage of the non-waterproof objects in the container, as well as cost effective solutions.

Also, often latches, such as slam latches, due to their design, provide an intrusion location for water to enter into the drawer. For example, latches, such as slam latches, may have holes or other openings that are necessary for the operation of the latch. However, these holes or openings are an intrusion point for water to enter the drawer area.

SUMMARY OF THE INVENTION

The present invention broadly comprises a water-resistant storage assembly, such as a drawer, featuring a series of self-draining faces adapted to redirect water away from the internal storage area and down a surrounding exterior wall or surface.

According to an embodiment, a water-resistant storage assembly is disclosed. The storage assembly may include a first face defining a channel disposed on an inward surface of the first face. The channel may have a profile and first and second edges. A sub-face may define a top-edge substantially matching the profile of the channel. The sub-face may be coupled to the inward surface of the first face, such that the top-edge is disposed between the first edge and second edge of the first face. A barrier plate may define a recess. The barrier plate may be coupled to sub-face such that the top-edge is disposed below the recess. A latch may be coupled to the first face. The latch may be disposed above the channel, the top-edge of the sub-face and the recess of the barrier plate. A floor and first and second side walls may each be coupled to the subface and define an internal storage area. The channel, the top-edge of the sub-face, and the recess of the barrier plate may define at least one flow path to the exterior of the first face for fluid, such as water. At least one flow path redirecting a fluid flow away from the internal area, thus minimizing any flow that enters the internal area.

According to another embodiment, a water-resistant drawer assembly is described. The drawer assembly may include a floor and first and second side walls. Each side wall may be coupled to the floor. A first drawer slide may be coupled to the first side wall and a second drawer slide may be coupled to the second side wall. A sub-face may be coupled to the floor and first and second side walls. The sub-face may define a top-edge. A first face may define a channel disposed on an inward surface of the first face and a latch void. The channel may have a profile and first and second edges. The profile may substantially match the top-edge of the sub-face. The first face may be coupled to the outward surface of the sub-face such that the top-edge is disposed between the first and second edges of the first face. A barrier plate may define a recess. The barrier plate may be coupled to the sub-face such that the top-edge is disposed below the recess. A latch may be disposed in the void of the first face. and above the channel, the top-edge of the sub-face and the recess of the barrier plate. The channel, the top-edge of the sub-face, and the recess of the barrier plate may define at least one flow path to the exterior of the first face. At least one flow path may redirect a fluid flow from entering the internal area.

According to another embodiment, a marine-grade storage compartment is provided. The compartment may include a floor, two side walls, a back, and a sub-face. The two side walls, the back and the sub-face may be coupled to the floor cooperatively forming an internal storage area. The sub-face may have a top-edge defining a U-shaped void. A barrier plate may define a milled recess. The barrier plate may be coupled to the sub-face such that the milled recess is disposed at a height above the top-edge of the sub-face in the U-shaped void and a bottom surface of the barrier plate engages the floor. An exterior face may define a channel and a drain disposed on an inward facing surface. The channel may have a width and a profile. The profile may be substantially similar to the top-edge of the sub-face. The exterior face may be coupled to an outward surface of the sub-face such that the top-edge is disposed at a height within the width of the channel. The channel, the top-edge of the sub-face, and the milled recess of the barrier plate may define at least one flow path to the drain of the exterior face. At least one flow path may redirect a fluid flow away from the internal storage area.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
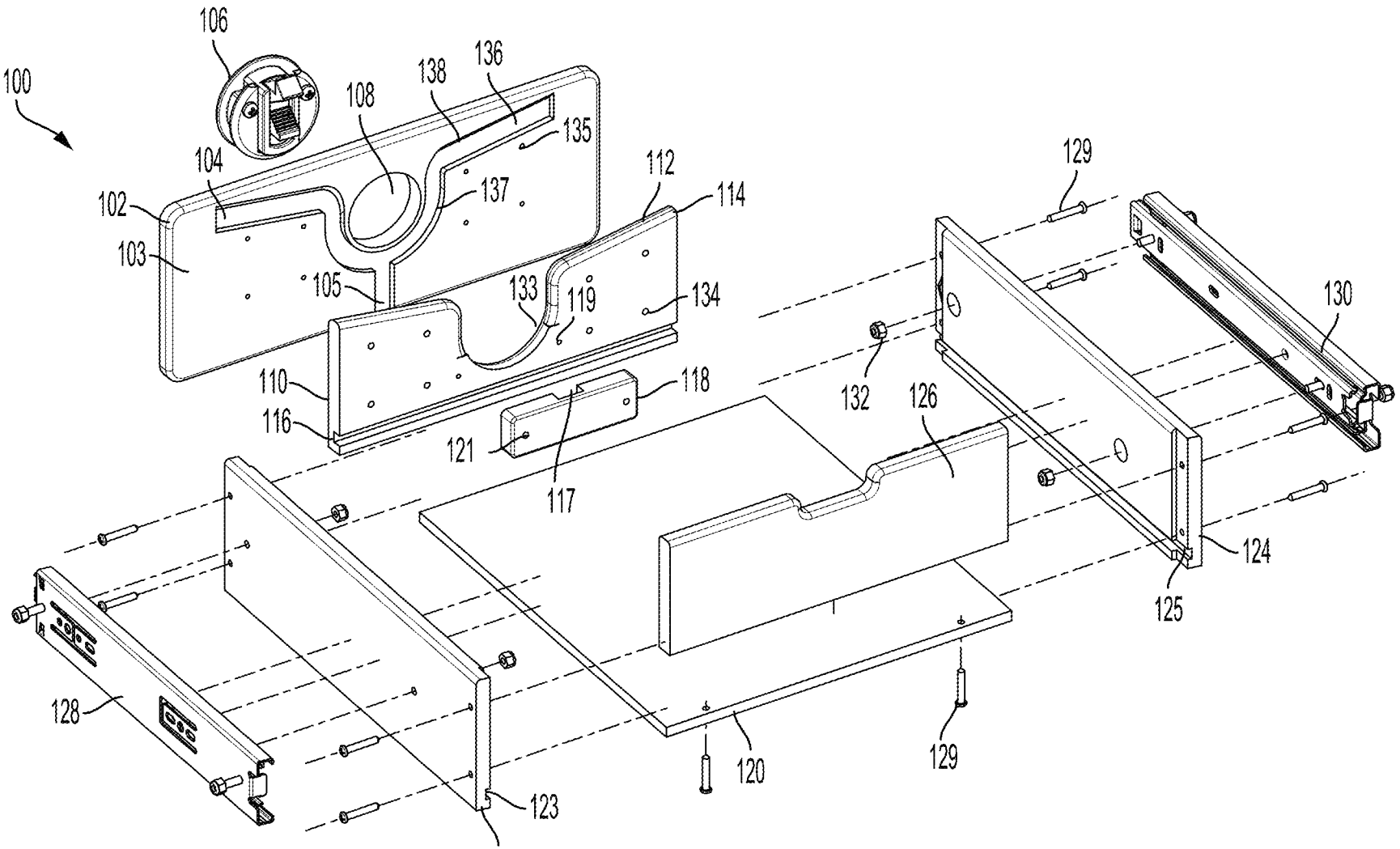
FIG. 1 is an exploded isometric view of a storage assembly, according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present invention relates broadly to a water-resistant storage assembly for a boat or other vehicle. According to an embodiment, the storage assembly may include a drawer assembly slidably coupled to a cabinet, wall, or other compartment. The storage assembly may include a series of faces featuring or defining drain channels adapted to redirect inbound water or other fluids away from the interior storage area and towards an external wall or other external surface, thus minimizing water penetration into the storage area.

Figure 2A:
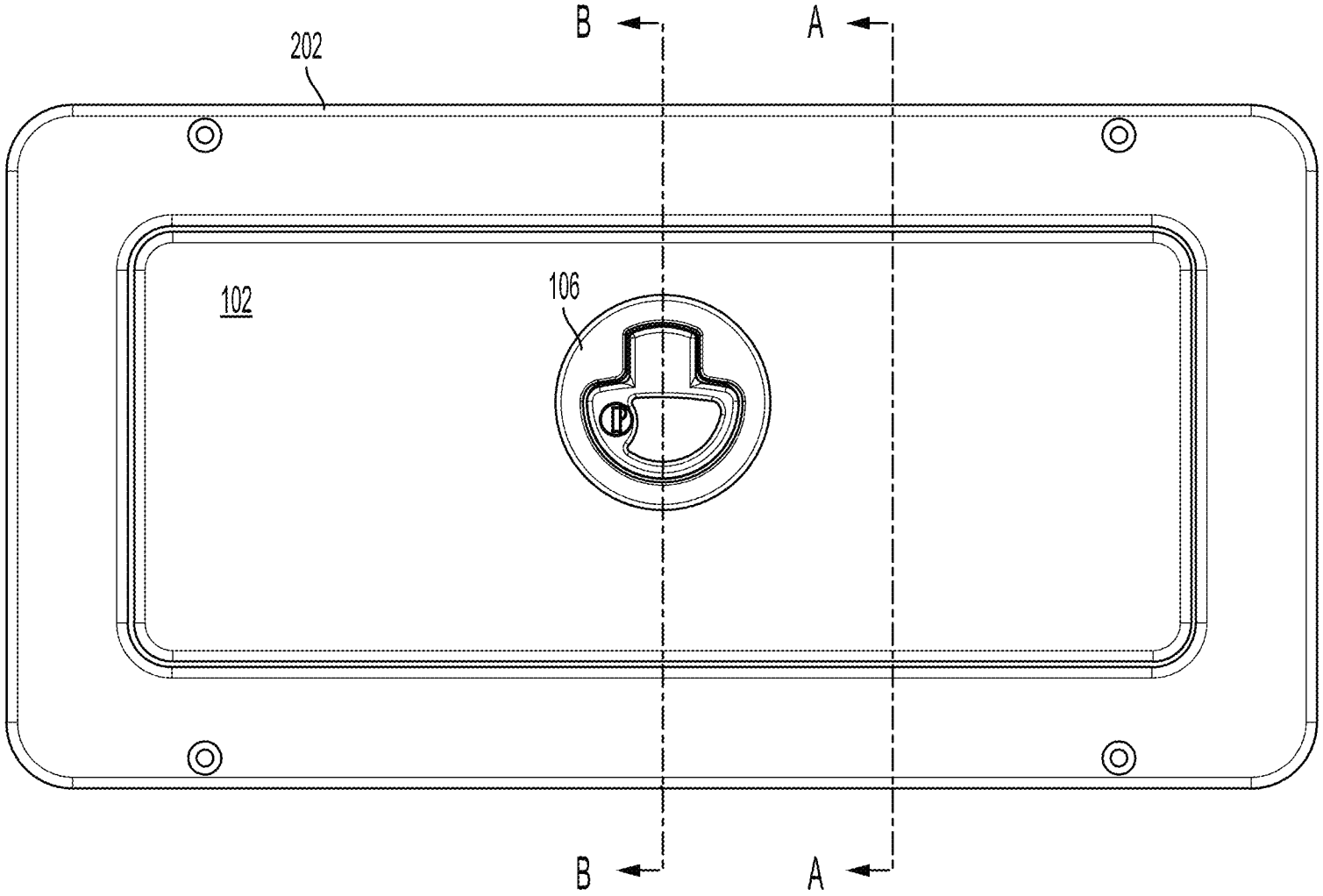
FIG. 2A is a front-view of the storage assembly of FIG. 1, according to an embodiment of the present invention.
Figure 2C:
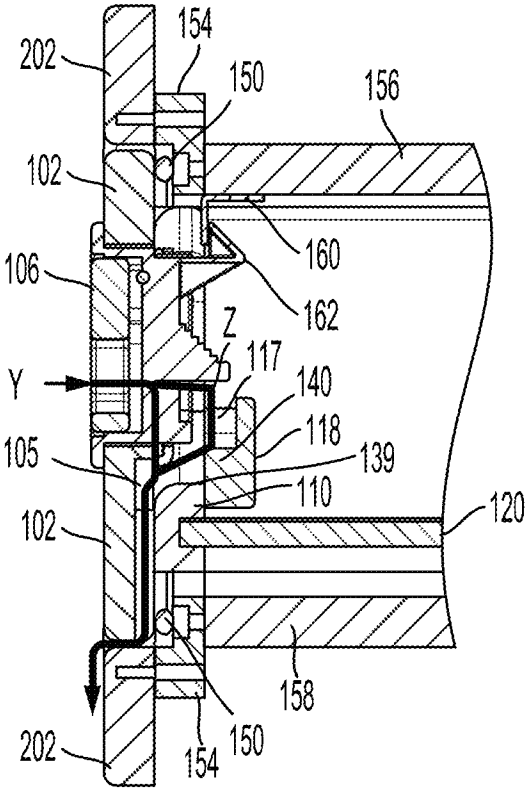
FIG. 2C is a sectional view of the storage assembly of FIG. 1, according to an embodiment of the present invention, taken across line B-B of FIG. 2A.

Referring to FIGS. 1-2C, a drawer assembly 100 is shown. The drawer assembly 100 may include a floor 120, a first side wall 122, a second side wall 124, a back wall 126, and a series of faces, including an exterior face 102, a sub-face 110, and a barrier plate 118. The wall and face components of the drawer assembly 100 may be made, for example, from a waterproof, marine-grade polymer, such as Starboard®, fiberglass, plastic, aluminum, or the like. According to an embodiment, the first side wall 122, second side wall 124, back wall 126, exterior face 102, sub-face 110, and barrier plate 118 may be formed from ½-inch Starboard® material, while the floor 120 may be formed from ¼-inch Starboard® material. The drawer assembly 100 may include a latch 106 coupled to at least the exterior face 102 to providing latching of the drawer assembly. According to an embodiment, the latch 106 may be a generally circular, stainless-steel slam latch, which is well-known. The latch 106 may be coupled to the exterior face 102 though a latch void 108 defined in the exterior face 102.

The first side wall 122 may include or define a horizontal groove 123 adapted to receive a side edge of the floor 120. The second side wall 124 may also include or define a horizontal groove 125 adapted to receive an opposite edge of the floor 120. The first and second side walls 122, 124 may further feature or define vertical grooves 127 (shown on the second side wall 124) adapted to receive the side edges of the back wall 126. The back wall 126 may be coupled to the floor by one or more fasteners, such as screws 129. The back wall 126 may also be coupled to the first and second side walls 122, 124 via on or fasteners, such as screws 129.

According to an embodiment, an inward facing wall 103 of the exterior face 102 may include a or define a channel 104. As explained below, the channel 104 may have a profile sized and shaped to accommodate and direct the flow of water entering the drawer assembly 100 from either over the top of the exterior face 102 or through the latch 106, and thus redirect such water away from the interior storage area. According to an embodiment, the channel 104 may include a substantially Y-shaped profile with sloped upper wings 136, a substantially U-shaped center 137 and a drain 105. The center 137 may be sized and shaped to substantially match the lower profile of the latch void 108. According to an embodiment, the wings 136 of the channel 104 may include or define an interior beveled top-edge 138. According to an embodiment, the interior beveled top-edge may include an approximately 45-degree beveled angle. The exterior face 102 may include or define holes 135 adapted to receives screws securing the exterior face 102 to the sub-face 110.

According to an embodiment, the sub-face 110 may include or define a horizontal groove 116 that is adapted to receive a front edge of the floor 120. The sub-face 110 may be coupled to the first and second side walls 122, 124 by one or more fasteners, such as screws 129, adhesive, or friction-fit. The sub-face 110 may also include or define holes 134 that are adapted to respectively receive screws or other fasteners (not shown) to couple the sub-face 110 to the exterior face 102 through the corresponding holes 135 in the exterior face 102. The sub-face 110 may further define or include holes 119 adapted to respectively receive screws or other fasteners (not shown) to couple sub-face 110 to the barrier plate 118 through corresponding holes 121 in the barrier plate 118.

According to an embodiment, the sub-face 110 may be formed to include a top-edge 112 including an approximately ¼-inch wide route formed along the side facing the exterior face 102 and a ⅛-inch route 114 formed on the inside facing edge of the sub-face 110. The top-edge 112 of the sub-face may generally slope downwardly from the outer edges towards the center of the subplate to a void 133 defined about the center of the sub-face 110. The top-edge 112, including the routed edges, as further explained below, may be adapted to direct water away from the interior storage area of the drawer assembly 100. The void 133 may also be sized and shaped to accommodate the latch 106. According to an embodiment, the void 133 may be generally U-shaped to accommodate a circular latch.

The barrier plate 118 may be disposed behind the sub-face 110 and is further adapted to redirect water away from, and minimize water intrusion into, the interior storage area. The barrier plate 118 may include or define a milled recess 117 sized and shaped to accommodate the latch 106. According to one embodiment the barrier plate 118 may be milled or otherwise formed to include a substantially semi-circular recess to accommodate a circular slam latch. The barrier plate 118 may be further sized and shaped such that when it is coupled to the sub-face 110, the bottom surface of the barrier plate 118 rests on or near the floor 120. The barrier plate 118 may also have a height that, in assembly, extends higher than the bottom edge 139 of the void 133 defined in the sub-face 110 (FIG. 2C). According to an embodiment, the milled recess 117 may also be sized and shaped to further direct water away from the internal storage area and towards the sub-face 112 and exterior face 102. As such, as shown in FIG. 2C, the milled recess 117 may include a bottom edge 140 that is disposed above the bottom edge 139 of the void 133 of the sub-face 110 (FIG. 2C).

According to an embodiment, the drawer assembly 100 may include a first drawer slide 128 coupled to the first side wall 122, and a second drawer slide 130 coupled to the second side wall 124. The first and second drawer slides 128, 130 may be coupled to the first and second side walls 122, 124, respectively by one or more bolts 131 and nuts 132, or similar fasteners, including, but not limited to, adhesive or friction-fit. The first drawer slide 128 and second drawer slide 130 may be a known slides made from stainless steel or other non-oxidizing material. The drawer slides 128, 130 may be adapted to couple to corresponding tracks or other suitable retaining devices (not shown) disposed in a wall, cabinet, or other void adapted to slidably receive the drawer assembly 100.

Figure 2B:
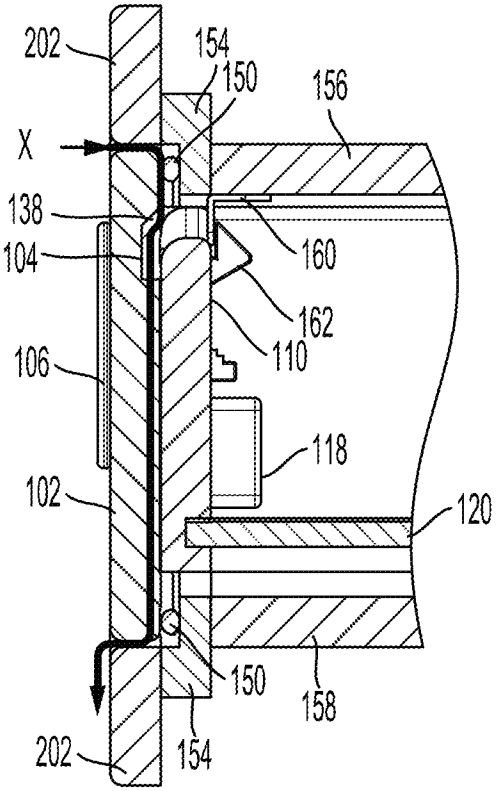
FIG. 2B is a sectional view of the storage assembly of FIG. 1, according to an embodiment of the present invention, taken across line A-A of FIG. 2A.

Referring now to FIGS. 2A-2C, an exemplary drawer assembly 100, as assembled, may be adapted to minimize or control the flow of water from both around the outside of the exterior face 102 and through the latch 106. Drawers and other sliding compartments have the disadvantage of having cracks or other open spaces between the drawer face and the surrounding cabinetry. This open space may allow for water and/or other contaminants to enter the drawer storage area. For example, as shown in FIG. 2A, the exterior face 102 of the drawer assembly 100 may be surrounded by a face plate 202. The face plate 202 may be coupled to a wall or other cabinetry to form a frame for the drawer assembly. The interface between the exterior edges of the exterior face 102 and the internal edges of the face plate 202 may form a gap through which water and other fluids may flow, particularly when faced with high-pressure and direct spray, such as from a hose or over-spray. In addition, latch 106 may also define one or more open flow paths allowing water to pass through the latch 106. According to embodiments of the present invention, the coupling of the exterior plate 102, the sub-face 110, and the barrier plate 118 form one or more flow channels adapted to redirect water flow away from the internal storage area of the drawer assembly 100 and down a surrounding wall or other surface, thus minimizing and controlling water intrusion into the internal storage area.

Referring to FIG. 2B, a partial section of the drawer assembly 100 taken across line A-A of FIG. 2A is shown. The drawer assembly 100 may be framed by face plate 202, which is fixedly coupled to a cabinet face 154. A top framework 156 and a bottom framework 158 may be coupled to the cabinet faces 154 to provide additional support and framing for the drawer assembly 100. A flange 160 may be coupled to the upper framework 156 and disposed in a manner to engage with a clasp 162 of the latch 106 when the drawer assembly 100 is in a closed position. To open the drawer assembly, the latch 106 may be actuated to release the clasp 162 from the flange 160 allowing the drawer assembly 100 to slide outward on the drawer slides 128, 130.

According to an embodiment, one or more seals 150 may be disposed about the perimeter of the cabinet face 154 at the interface between the exterior face 102 and the cabinet face 154. According to an embodiment, the seals 150 may be a pedestal bulb seal. The seal 150 may be adapted to form a fluid-resistant interface between the exterior face 102 and the cabinet face 154. The seal 150 may also help redirect water flow toward the channel 104, the drain 105, and ultimately to an outer surface of the drawer assembly 100.

As shown by the flow path X of FIG. 2B, any water inflowing over the top edge of the exterior face 102 that flows past the seal 150 is directed downward and into the channel 104. The top-edge 112 of the sub-face 110 is also adapted to direct water flow towards the channel 104. The inward bevel 138, for example at about 45-degrees, allows the water to flow away from the sub-face and into the wings 136 of channel 104. From the wings 136, the water may flow to the center 137 and on to the drain 105 portions of the channel 104, which drains outside of the drawer assembly. Water flow may exit the drawer assembly 100 through the bottom edge of the exterior plate 102 and down the outside of the face plate 202.

Referring to FIG. 2C, a partial section of the drawer assembly 100 taken across line B-B of FIG. 2A is shown. Line B-B extends through the center of the drawer assembly through the latch 106. A flow path Y is shown representing the flow of water introduced to the drawer assembly through the latch 106. The flow Y into the latch is directed downwardly towards and into the channel 104. The disposition of the latch 106 in and above the center 137 of the channel 104 allows the water to flow through the center 137 and down the drain 105, exiting the drawer assembly 100 along the bottom edge of the exterior plate 102 and down the outside face of the face plate 202. Additionally, any water that reaches past the latch 106, shown as flow path Z, may be blocked and redirected by the barrier plate 118, thus minimizing water intrusion. Such flow may be collected in the milled recess 117 and directed over the top-edge 139 of void 133.

Significantly, the present invention can be adapted and utilized with existing drawers, in that existing drawers can be milled to create the channels, and other components can be coupled to the drawer, as set forth above, to create a water-resistant drawer. Accordingly, the present invention provides a cost-effective solution for creating water resistant drawers.

Figure 3:
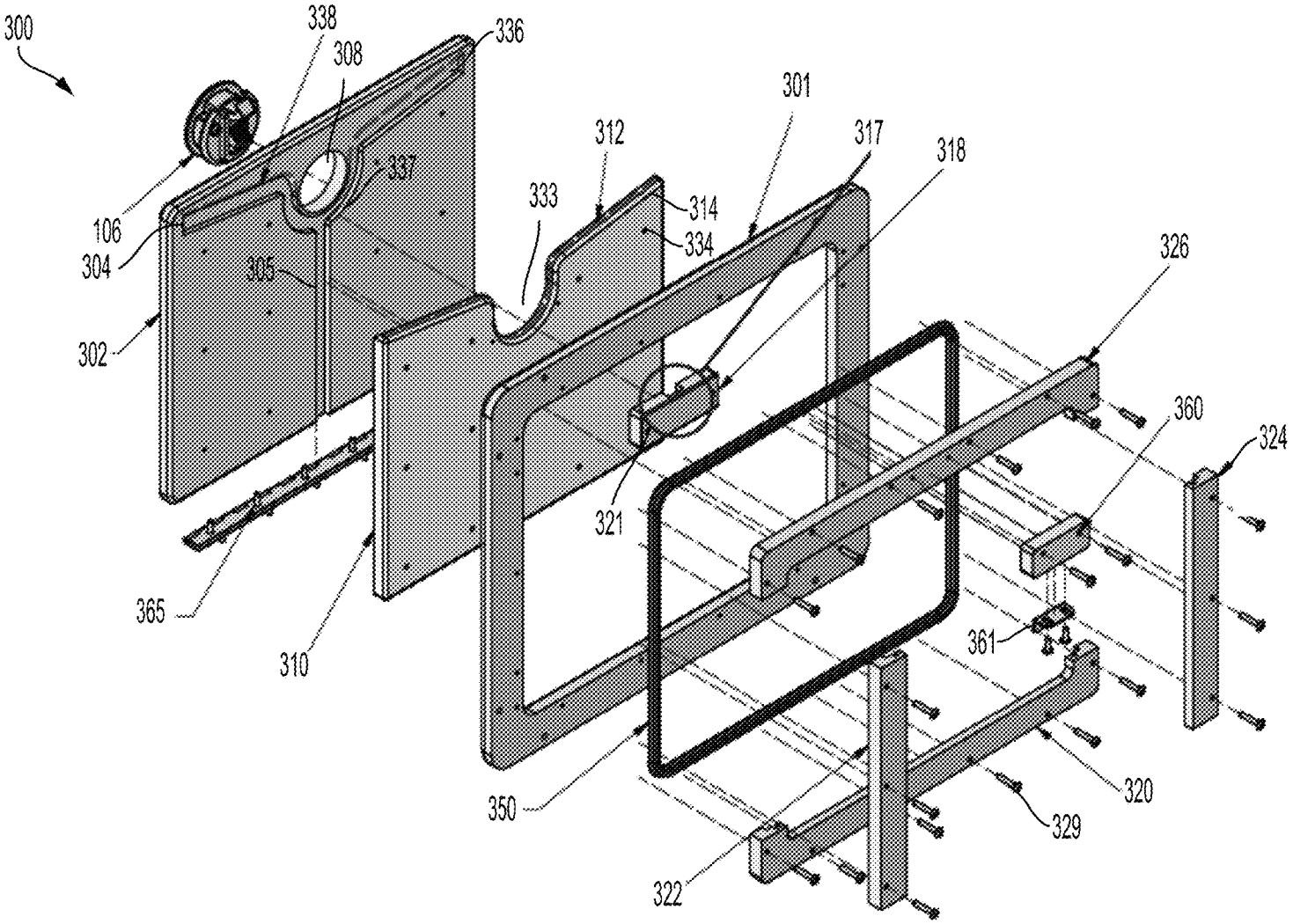
FIG. 3 is an exploded isometric view a storage assembly door according to an embodiment of the present invention.
Figure 4C:
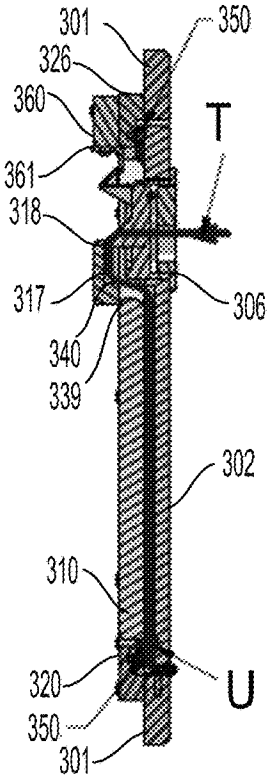
FIG. 4C is a sectional view of the storage assembly of FIG. 3, according to an embodiment of the present invention, taken across line D-D of FIG. 4A.
Figure 4B:
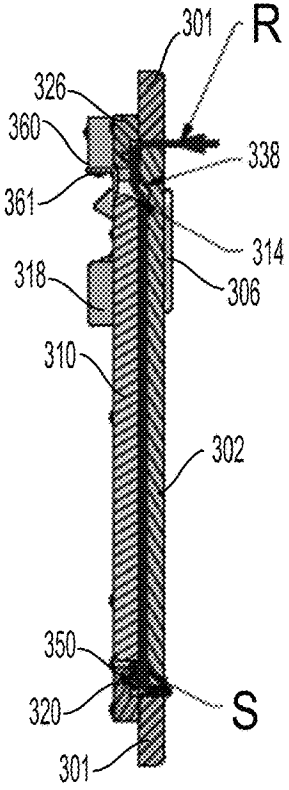
FIG. 4B is a sectional view of the storage assembly door of FIG. 3, according to an embodiment of the present invention, taken across line C-C of FIG. 4A.

Referring to FIGS. 3-4C, an embodiment of a storage assembly door 300 is shown. According to an embodiment, the storage assembly door 300 may be coupled to a cabinet, drawer, or other storage structure by one or more hinges 365, such as a piano hinge, door hinge or the like. As an alternative to a drawer configuration, as described herein, a hinged coupling of the storage assembly drawer 300 may provide easy access to a cabinet or storage area that is not adapted to receive a drawer. As described below, certain of the water-resistant characteristics of the storage assembly 300 may be like those of the drawer assembly of FIGS. 1-2C.

For example, the storage assembly door 300 may include a door face 302 defining a latch void 308 adapted to receive a latch 306, such as a stainless-steel slam latch. The storage assembly door 300 may also include a subface 310 coupled to the door face 302 and define a void 333 sized and shaped to accommodate the latch 306. A barrier plate 318 defining a milled recess 317 may be coupled to the subface 310. The piano hinge 365 may be coupled to a bottom edge of the door face 302.

According to an embodiment, an inward facing wall 303 of the door face 302 may include a or define a channel 304. As explained below, the channel 304 may have a profile sized and shaped to accommodate and direct the flow of water entering the storage door assembly 300 from either over the top of the drawer face 302 or through the latch 306, and thus redirect such water away from the interior storage area. According to an embodiment, the channel 304 may include a substantially Y-shaped profile with sloped upper wings 336, a substantially U-shaped center 337 and a drain 305. The center 337 may be sized and shaped to substantially match the lower profile of the latch void 308. According to an embodiment, the wings 336 of the channel 304 may include or define an interior beveled top-edge 338. According to an embodiment, the interior beveled top-edge 338 may include an approximately 45-degree beveled angle. The door face 302 may include or define holes 335 adapted to receive screws securing the door face 302 to the sub-face 310.

According to an embodiment, the sub-face 310 may include or define holes 334 that are adapted to respectively receive screws or other fasteners (not shown) to couple the sub-face 310 to the door face 302 through the corresponding holes 335 in the door face 302. The sub-face 310 may further define or include holes 319 adapted to respectively receive screws or other fasteners (not shown) to couple sub-face 310 to the barrier plate 318 through corresponding holes 321 in the barrier plate 318.

According to an embodiment, the sub-face 310 may be formed to include a top-edge 312 including an approximately ¼-inch wide route formed along the side facing the door face 302 and a ⅛-inch route 314 formed on the inside facing edge of the sub-face 310. The top-edge 312 of the sub-face 310 may generally slope downwardly from the outer edges towards the center of the sub-face 310 to the void 333 defined about the center of the sub-face 310. The top-edge 312, including the routed edges, as further explained below, may be adapted to direct water away from the interior storage area beyond the storage door assembly 300. The void 333 may also be sized and shaped to accommodate the latch 306. According to an embodiment, the void 333 may be generally U-shaped to accommodate a circular latch.

The barrier plate 318 may be disposed behind the sub-face 310 and is further adapted to redirect water away from, and minimize water intrusion into, the interior storage area beyond the storage assembly door 300. The barrier plate 318 may include or define a milled recess 317 sized and shaped to accommodate the latch 306. According to one embodiment the barrier plate 318 may be milled or otherwise formed to include a substantially semi-circular recess to accommodate a circular slam latch. According to an embodiment, the milled recess 317 may also be sized and shaped to further direct water away from the internal storage area and towards the sub-face 310 and door face 302. As such, as shown in FIG. 3C, the milled recess 317 may include a bottom edge 340 that is disposed above the bottom edge 339 of the void 333 of the sub-face 310 (FIG. 4C).

The storage door assembly 300 may include a face plate 301 coupled to a cabinet or other structure adapted to frame the door face 302, sub-face 310 and barrier plate 318. The face plate 301 may be coupled to a top return 326, first side return 322, a second side return 324 and a bottom return 320. The returns may be coupled to the face plate 301 by a plurality of fasteners, such as screws 329 A seal 350, such as a bulb seal, may be disposed about an outward facing wall of the top return 326, bottom return 320 first side return 322 and second side return 326. The seal 350 may be configured to provide a fluid resistant seal between returns and the door face 302 (FIG. 4C).

A catch block 360 may be coupled to an inward facing wall of the top return 326. A flange 361 may be coupled to the catch block 360 and be adapted to receive and secure the latch 306. When the latch 306 is secured by the flange 361 or the catch block 360, the door face 302 may compress the seal 350 against the top return 326, bottom return 320 first side return 322 and second side return 326.

Figure 4A:
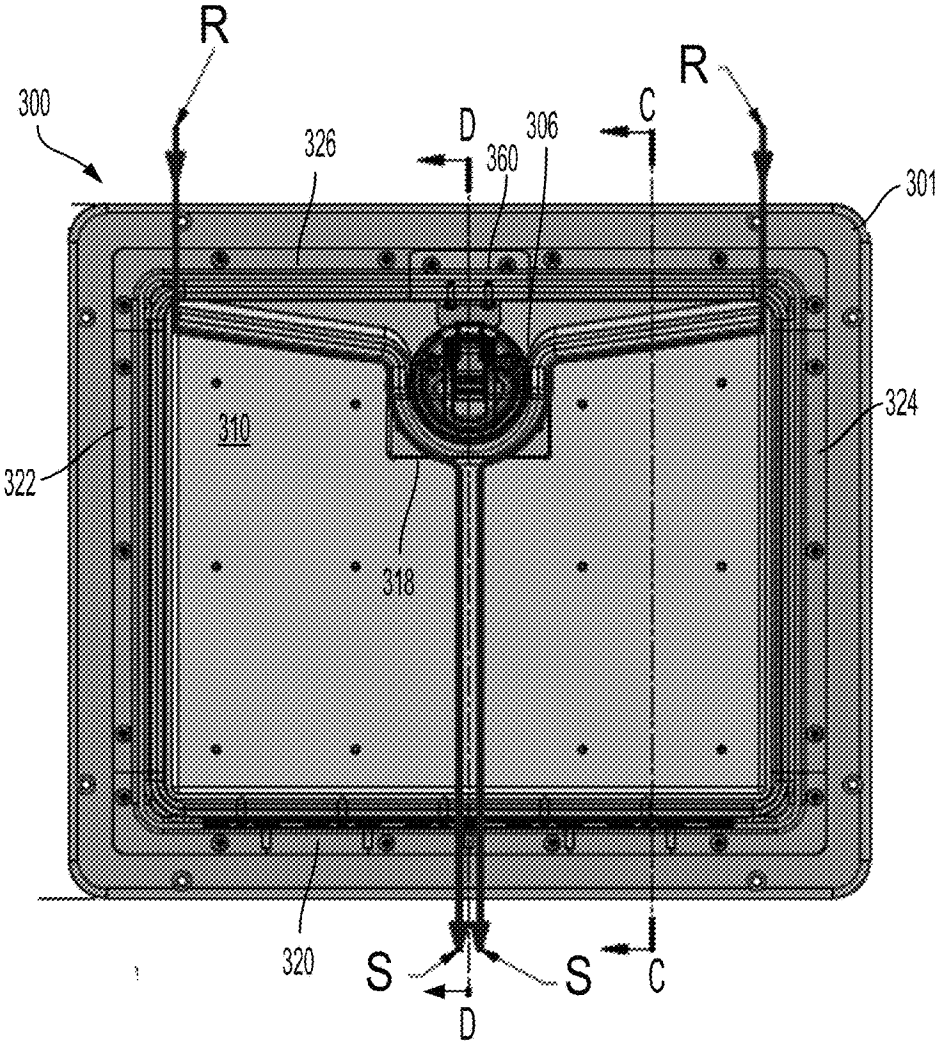
FIG. 4A is a rear-view of the storage assembly of FIG. 1, according to an embodiment of the present invention.

Referring to FIG. 4A, a rear-view of storage door assembly 300 is shown. According to an embodiment, the storage door assembly 300 may be adapted to redirect an inward water flow, R, entering between the top of the door face 302 and the face plate 301. As also shown in the sectional view of FIG. 4B across line C-C of FIG. 4A, the water flow R may enter between the top of the door face 302 and the face plate 301. The top return 326 may redirect the flow over the top-edge 312 and routed outer edge of the sub-face 310 into the wings 336 of the channel 304. The water flow may then proceed to the center 337 and down the drain 305 of the channel 304, exiting the storage door assembly 300 at point S.

Additionally, the storage door assembly 300 may be adapted to prevent the flow of water through the latch 306 from entering the internal storage area. FIG. 4C depicts a sectional-view of the storage door assembly 300 taken across line D-D of FIG. 4A. Water flow, T, may enter the storage door assembly 300 through the latch 306 where it may be redirected by barrier plate 318 through the milled recess 317 and over the top-edge 312 of the sub-face 310 into the center 337 of the channel 304. The water flow T may then flow through the drain 305 and exit the storage door assembly 300 at point U.

Significantly, the present invention can be adapted and utilized with existing cabinetry and doors, in that existing doors can be milled to create the channels, and other components can be coupled to the door, as set forth above, to create a water-resistant door. Accordingly, the present invention provides a cost-effective solution for creating water resistant doors.

While embodiments herein describe a storage assembly for a boat or other water-bound vehicle, one skilled in the art will recognize that the scope of the invention is not limited to such vehicles. Embodiments of the present invention may be used in any environment in which a protected storage compartment is desired, including without limitation, vehicles such as cars, planes or the like as well as, kitchens, garages, and other household or commercial areas.

While the embodiments described herein detail a storage assembly adapted to prevent water from entering an internal storage area, one skilled in the art will recognize that the described assemblies are not limited only water, rather the embodiments described are adapted to prevent the flow of other fluids and materials.

As used herein, the term "coupled" can mean any physical, electrical, magnetic, or other connection, either direct or indirect, between two parties. The term "coupled" is not limited to a fixed direct coupling between two entities.

As used herein terms denoting direction, order, or orientation such as "first," "second," "horizontal," "vertical," "lateral," "top," "bottom," "left," "right," "over," "under," "above," "below," "front," back," or the like, are non-limiting and used herein for ease of explanation. One of skill in the art will recognize the use of these terms as merely descriptive examples that do not limit the placement, orientation, or disposition of the elements described using such terms.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A storage assembly comprising:

a first face having a channel disposed on an inward surface of the first face, the channel having a profile and first and second edges;

a sub-face defining a top-edge, the top-edge substantially matches the profile of the channel, the sub-face is coupled to the inward surface of the first face such that the top-edge is disposed between the first and second edges; and a floor and a first and second side walls, each coupled to the subface, wherein the floor, the first and second side walls, and the sub-face cooperatively define an internal area;

wherein the channel and the top-edge of the sub-face cooperatively define a flow path to the exterior of the first face, the flow path is adapted to redirect fluid away from the internal area.

2. The storage assembly of claim 1, further comprising:

a barrier plate defining a recess, the barrier plate is coupled to sub-face such that the top-edge is disposed below the recess; and a latch coupled to the first face, the latch is disposed above the channel, the top-edge of the sub-face and the recess of the barrier plate;

wherein the channel, the top-edge of the sub-face, and the recess of the barrier plate cooperatively define the flow path.

3. The storage assembly of claim 1, further comprising:

a cabinet defining a first void adapted to receive the internal area; and a seal disposed on the cabinet, the seal engaging a perimeter of the first face.

4. The storage assembly of claim 3, wherein the seal is a pedestal bulb seal.

5. The storage assembly of claim 2, further comprising a flange coupled to the cabinet, the latch adapted to releasably couple to the flange.

6. The storage assembly of claim 1, further comprising a faceplate coupled to the cabinet, the faceplate defining an opening sized to accommodate the first face.

7. The storage assembly of claim 1, further comprising a back wall coupled to the floor.

8. The storage assembly of claim 2, wherein the latch is a slam latch.

9. The storage assembly of claim 1, wherein the first edge of the channel includes a downward bevel at about 45-degrees.

10. The storage assembly of claim 1, wherein the top-edge of the sub-face includes a ¼-inch route towards the first face.

11. The storage assembly of claim 1, wherein the top-edge of the sub-face includes a ⅛-inch route towards the internal area face.

12. The storage assembly of claim 2, wherein the first face defines a latch void adapted to receive the latch.

13. The storage assembly of claim 2, wherein the channel is a substantially Y-shaped channel including first and second wings, a U-shaped center, and a drain.

14. The storage assembly of claim 13, wherein the U-shaped center defines a latch void adapted to receive the latch.

15. The storage assembly of claim 1, wherein the channel substantially spans a width of the front face.

16. The storage assembly of claim 1, wherein the channel slopes downwardly and includes a drain ending at a bottom edge of the first face.

17. The storage assembly of claim 1, further comprising a first drawer slide coupled to the first sidewall and a second drawer slide coupled to the second side wall.

18. The storage assembly of claim 2, wherein the recess of the barrier plate includes a semi-circular recess milled on an outer surface facing the sub-face.

19. A water-resistant drawer assembly, comprising:

a floor;

a first and second side walls, each side wall coupled to the floor;

a first drawer slide coupled to the first side wall and a second drawer slide coupled to the second side wall;

a sub-face coupled to the floor and the first and second side walls, the sub-face defining a top-edge;

a first face defining a channel on an inward surface of the first face and a latch void, the channel having a profile, a first edge and a second edge, the profile substantially matches the top-edge of the sub-face, the first face is coupled to the outward surface of the sub-face such that the top-edge is disposed between the first and seconds edges of the first face;

a barrier plate defining a recess, the barrier plate is coupled to sub-face such that the top-edge is disposed below the recess; and a latch disposed in the void of the first face, the latch is disposed above the channel, the top-edge of the sub-face and the recess of the barrier plate;

wherein the channel, the top-edge of the sub-face, and the recess of the barrier plate cooperatively define a flow path to the exterior of the first face, the flow path is adapted to redirect fluid away from the internal area.

20. A storage compartment for a boat, comprising:

a floor, two side walls, a back, and a sub-face, the side walls, the back and the sub-face coupled to the floor to cooperatively define an internal area, the sub-face having a top-edge defining a U-shaped void;

a barrier plate defining a milled recess, the barrier plate is coupled to the sub-face such that the milled recess is disposed at a height above the top-edge of the sub-face in the U-shaped void and a bottom surface of the barrier plate engages the floor; and an exterior face defining a channel and a drain on an inward facing surface, the channel having a width and a profile, the profile being substantially similar to the top-edge of the sub-face, the exterior face is coupled to an outward surface of the sub-face such that the top-edge is disposed at a height within the width of the channel;

wherein the channel, the top-edge of the sub-face, and the milled recess of the barrier plate cooperatively define a flow path to the drain of the exterior face, the flow path is adapted to redirect a fluid flow away from the internal area.

* * * * *